US008416144B2

(12) United States Patent
Lindberg et al.

(10) Patent No.: US 8,416,144 B2
(45) Date of Patent: Apr. 9, 2013

(54) REFLECTOR, AN ANTENNA USING A REFLECTOR AND A MANUFACTURING METHOD FOR A REFLECTOR

(75) Inventors: Christofer Lindberg, Vallentuna (SE); Jesper Uddin, Stockholm (SE); Johan Edlund, Taby (SE); Per-Anders Arvidsson, Solna (SE)

(73) Assignee: Powerwave Technologies Sweden AB, Taby (SE)

( * ) Notice: Subject to any disclaimer, the term of this patent is extended or adjusted under 35 U.S.C. 154(b) by 0 days.

(21) Appl. No.: 11/658,692

(22) PCT Filed: Jul. 25, 2005

(86) PCT No.: PCT/SE2005/001178

§ 371 (c)(1), (2), (4) Date: Nov. 17, 2008

(87) PCT Pub. No.: WO2006/011844

PCT Pub. Date: Feb. 2, 2006

(65) Prior Publication Data

US 2009/0066602 A1 Mar. 12, 2009

(30) Foreign Application Priority Data

Jul. 28, 2004 (SE) ..... 0401941

(51) Int. Cl.
*H01Q 19/10* (2006.01)

(52) U.S. Cl. ..... 343/834

(58) Field of Classification Search ..... 343/834, 343/805, 882, 853, 858, 862, 795
See application file for complete search history.

(56) References Cited

U.S. PATENT DOCUMENTS

| | | | | |
|---|---|---|---|---|
| 3,949,406 | A | 4/1976 | Yvard | |
| 4,295,142 | A | 10/1981 | Thiere et al. | |
| 4,477,816 | A | 10/1984 | Cho | |
| 4,533,919 | A | 8/1985 | Dragone | |
| 5,532,707 | A * | 7/1996 | Klinger et al. | 343/793 |
| 5,973,652 | A * | 10/1999 | Sanford et al. | 343/781 P |
| 6,028,563 | A * | 2/2000 | Higgins | 343/797 |

(Continued)

FOREIGN PATENT DOCUMENTS

| | | |
|---|---|---|
| EP | 0730319 | 9/1996 |
| FR | 2 369 575 | 10/1976 |

(Continued)

OTHER PUBLICATIONS

International Search Report and Written Opinion, dated Sep. 28, 2005.

(Continued)

*Primary Examiner* — Huedung Mancuso
(74) *Attorney, Agent, or Firm* — OC Patent Law Group

(57) ABSTRACT

The present invention relates to a reflector 20; 30; 40 for use in an antenna 10; 50. The reflector 20; 30; 40 is arranged to be used as an earth plane of the antenna 10 and the reflector is corrugated to form current pockets. The reflector 20; 30; 40 comprises at least two separate parts 21, 22; 21, 22, 31, 32; 41, 42, and the parts are electrically coupled to each other to commonly form the earth plane of the antenna 10; 50. The invention also relates to an antenna including a reflector, and to a method for manufacturing a reflector.

10 Claims, 3 Drawing Sheets

U.S. PATENT DOCUMENTS

| | | | | |
|---|---|---|---|---|
| 6,029,563 | A * | 2/2000 | Nakagawa et al. | 99/327 |
| 6,144,345 | A * | 11/2000 | Kuether | 343/834 |
| 6,229,496 | B1 * | 5/2001 | Eriksson | 343/795 |
| 6,362,789 | B1 * | 3/2002 | Trumbull et al. | 343/700 MS |
| 6,608,600 | B2 * | 8/2003 | Eriksson | 343/797 |
| 6,747,606 | B2 * | 6/2004 | Harel et al. | 343/808 |
| 6,853,346 | B2 | 2/2005 | Annabi et al. | |
| 6,924,776 | B2 * | 8/2005 | Le et al. | 343/792.5 |
| 7,443,356 | B2 * | 10/2008 | Roberts et al. | 343/797 |
| 2005/0104782 | A1 * | 5/2005 | Peled et al. | 343/702 |
| 2005/0219140 | A1 * | 10/2005 | Browne et al. | 343/814 |

FOREIGN PATENT DOCUMENTS

| | | |
|---|---|---|
| JP | 2000-307337 | 11/2000 |
| WO | WO 98/54785 | 12/1998 |
| WO | WO 00/01032 | 1/2000 |
| WO | WO 03/043128 | 5/2003 |

OTHER PUBLICATIONS

Supplementary European Search Report and Annex for Application No. EP 05760063.7-1248/1771920 PCT/SE2005001178 dated Apr. 29, 2009.

* cited by examiner

REFLECTOR, AN ANTENNA USING A REFLECTOR AND A MANUFACTURING METHOD FOR A REFLECTOR

TECHNICAL FIELD

The present invention relates to a reflector of the type defined in the preamble of claim 1. The invention also relates to an antenna using a reflector as defined in the preamble of claim 9 and a manufacturing method for a reflector as defined in the preamble of claim 10.

BACKGROUND TO THE INVENTION

Corrugations are well known in the art for shaping of antenna patterns, for example in horn antennas see U.S. Pat. Nos. 3,949,406, 4,295,142, 4,477,816, 4,533,919. Corrugated reflectors are also used in base station antennas for mobile communication. These reflectors are manufactured using extruded profiles with corrugations or current traps, which in function are shorted quarter wavelengths parallel plate wave guides, making one polarization of the currents see a high (infinite) impedance. By using this corrugations/current traps the currents on the reflector can be controlled and thereby the radiated fields of the antenna are controlled. For the lower frequencies used in mobile communications (400-1000 MHz) these extruded profiles tends to be very bulky and heavy.

SUMMARY OF THE INVENTION

An object with the present invention is to provide a reflector, and an antenna, that is less bulky and lighter than prior art reflectors.

Another object with the invention is to provide a method for manufacturing a reflector that will produce a reflector that is less bulky and lighter than prior art reflectors.

An advantage with the present invention is that a complex reflector may be manufactured at a very low cost.

A further advantage is that the reflector is much lighter than corresponding reflectors according to prior art.

Still a further advantage is that the physical properties of the reflector are considerable smaller than a reflector that is manufactured using prior art techniques.

In a preferred embodiment of the present invention, sheet metal parts are taped together using a non-conducting tape. The above mentioned corrugations/current traps can thereby be manufactured without using extrusion. By using a big enough taping area the capacitance between the taped sheet metal parts can be made very big, which in turn make impedance across the taping very low. A corrugation/current trap can then be manufactured to function even though there are non-conducting contacts. It is obvious to anyone skilled in the art that other shapes than corrugations can be created this way, for example shielding walls and baffles.

DETAILED DESCRIPTION OF PREFERRED EMBODIMENTS

Figure 1:
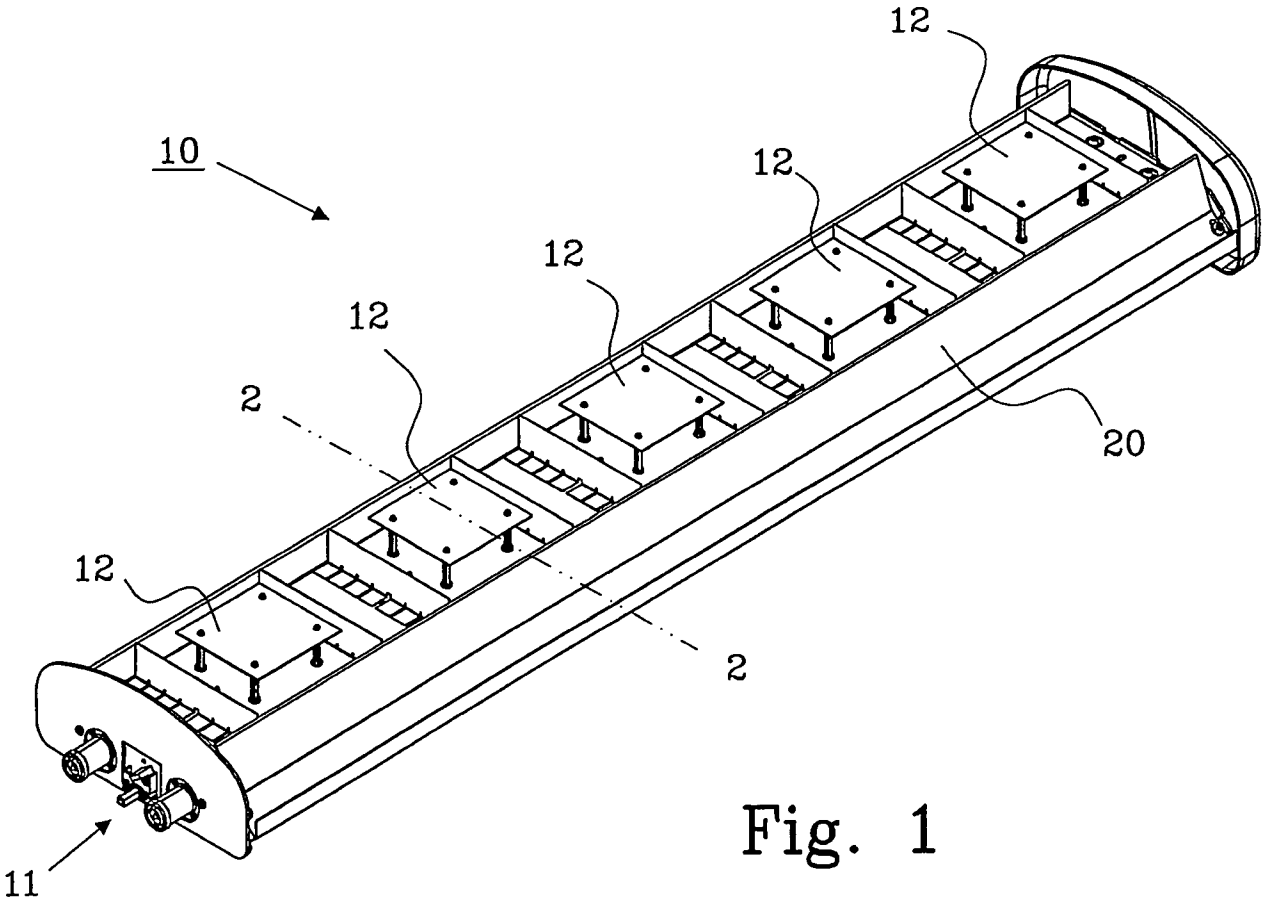
FIG. 1 shows a perspective view of an antenna with a first embodiment of a reflector according to the present invention.

FIG. 1 shows a perspective view of an antenna 10, preferably used for mobile communication, with a first embodiment of a reflector 20 according to the present invention. The antenna comprises input/output connections 11, for feeding signals to/from the antenna 20, antenna elements 12, for transmitting and receiving RF signals in different frequency bands, a distribution network (not shown), such as a phase-shifter, for distributing signals between the input/output connections 11 and respective antenna element 12, and a casing (not shown), mainly for protecting the antenna elements from the environment.

The antenna 10 comprises five antenna elements 12, but may comprise of fewer, or more, than that, e.g. only one antenna element is possible. In that case a distribution network is not necessary to distribute the signals within the antenna 10.

Figure 2:
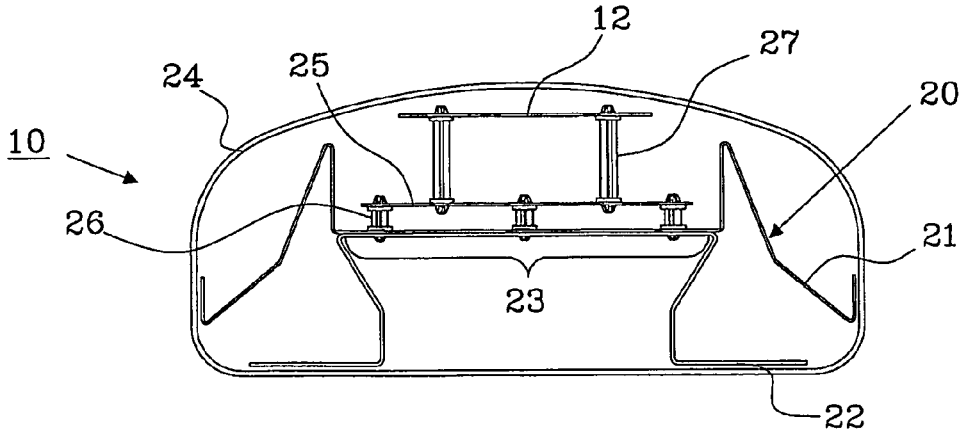
FIG. 2 shows a cross-sectional view of the antenna in FIG. 1 along line 2-2.

FIG. 2 shows a cross-sectional view of the antenna 10 in FIG. 1 along line 2-2. The reflector 20 of the antenna 10 comprises, in this first embodiment, of two separate parts. An upper part 21 and a lower part 22 are electrically coupled to each other in a first region, denoted 23. The electrical coupling may be an indirect coupling, such as a capacitive coupling, or a direct coupling.

A capacitive coupling can be made by using a non-conductive adhesive, e.g. tape or glue, between the reflector parts 21 and 22. A direct electrical coupling can be achieved by spot welding, anodizing and bolting or by using a conductive adhesive.

The antenna element 12 is arranged on top of the reflector in such a way that the reflector functions as ground plane for the antenna 10. A casing 24 surrounds the antenna element 12 and the first part 21 and second part 22 of the reflector 20. A distribution network is arranged on the reverse side of a support 25 arranged between the antenna element 12 and the reflector 20. The antenna element 12 and the support 25 are separated from each other and the reflector 20 by non-conducting distance elements 26, 27.

Figure 3:
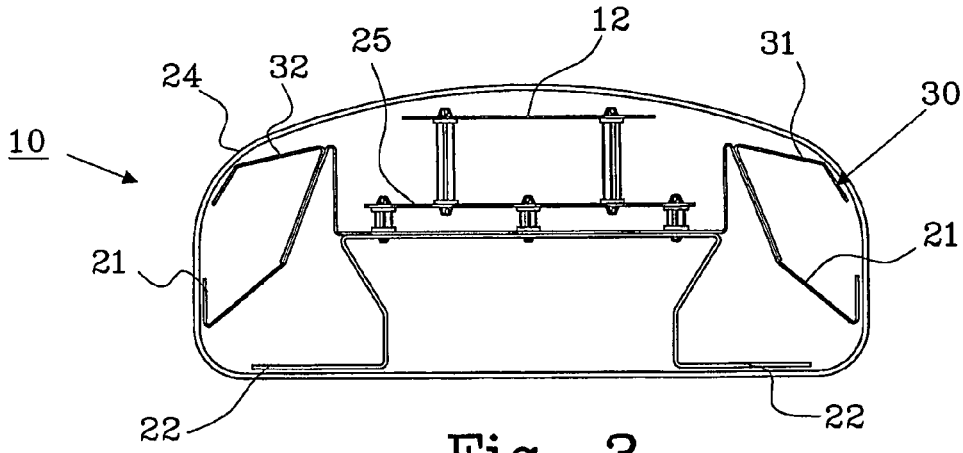
FIG. 3 shows a cross-sectional view of an antenna with a second embodiment of a reflector according the present invention.

FIG. 3 shows a cross-sectional view of an antenna 10 with a second embodiment of a reflector 30 according the present invention. The reflector 30 comprises a first part 21 and a second part 22, as described in connection with FIG. 2, a third part 31, which is electrically coupled to one side of the first part 21, and a fourth part 32, which is electrically coupled to a second side of the first part 21.

The antenna element 12 is arranged to the reflector 30 in a similar way as described in connection with FIG. 2, and a casing 24 is also provided surrounding the essential parts.

The third part 31 and fourth part 32 of the reflector 30 is electrically coupled to the first part 21 either indirectly or directly. An indirect coupling, such as a capacitive coupling, can be made by using a non-conductive adhesive, e.g. tape or glue, between the reflector parts 21 and 22. A direct electrical coupling can be achieved by spot welding, anodizing and bolting or by using a conductive adhesive.

Figure 4:
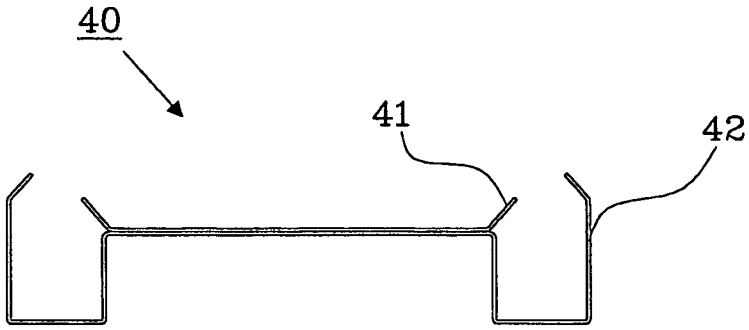
FIG. 4 shows a cross-sectional view of a third embodiment of a reflector according to the present invention.

FIG. 4 shows a cross-sectional view of a third embodiment of a reflector 40 according to the present invention. The reflector 40 comprises two parts 41 and 42. This reflector is adapted to be mounted in an antenna that has a different loob pattern compared to the reflector described in FIGS. 1-3.

The loob pattern of the reflector shown in FIG. 4 has a 65 degrees 3 dB beam width and the reflectors shown in FIGS. 1-3 has 90 degrees 3 dB beam width.

Figure 5:
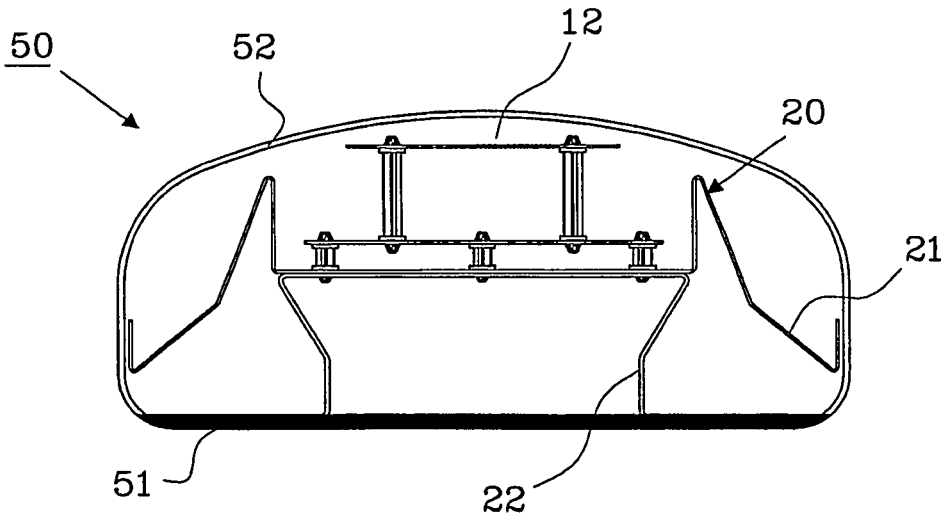
FIG. 5 shows an alternative embodiment of an antenna with the first embodiment of the reflector according to the present invention.

FIG. 5 shows an alternative embodiment of an antenna 50 with the first embodiment of the reflector 20 according to the present invention. The casing of the antenna 50 comprises a base 51 and a cover 52. The second part 22 of the reflector 20 is integrated in the base 51 of the casing, and the first part 21 of the reflector 20 is electrically coupled to the second part 22 when mounting the antenna to its operating position in a communication mast.

The invention claimed is:

1. A reflector for use in an antenna, the reflector being arranged to be used as a ground plane of the antenna and the reflector is corrugated to form current traps, the reflector comprises at least two separate parts being electrically coupled to each other in a first region to commonly form said ground plane, said first region being arranged behind at least one antenna element in use, and said at least two separate parts together forming at least one pair of partially enclosed cavities functioning as said current traps, wherein said pair of partially enclosed cavities extends symmetrically from each side of said first region in an outward direction thereof.

2. The reflector according to claim 1, wherein said reflector parts are made from folded metal sheet.

3. The reflector according to claims 1, wherein said reflector parts are made from aluminum.

4. The reflector according to claims 1, wherein said reflector parts have a capacitive coupling to each other.

5. The reflector according to claim 4, wherein said capacitive coupling is achieved by providing a non-conductive adhesive, such as tape, between the reflector parts.

6. The reflector according to claims 1, wherein said reflector parts have a direct electrical coupling to each other.

7. The reflector according to claim 6, wherein said direct electrical coupling is achieved by spot welding, anodizing and bolting, or using a conductive adhesive.

8. The reflector according to claims 1, wherein said reflector comprises more than two separate parts.

9. An antenna comprising at least one antenna element mounted to a corrugated reflector with current traps which is used as a ground plane in the antenna, wherein each said antenna element is connected to a distribution network that in turn is connected to an incoming signal feed, wherein said reflector comprises at least two separate parts, wherein said parts are electrically coupled to each other in a first region to commonly form said ground plane, said first region being arranged behind said at least one antenna element, and said at least two separate parts together forming at least one pair of partially enclosed cavities functioning as said current traps, wherein said pair of partially enclosed cavities extends symmetrically from each side of said first region in an outward direction thereof.

10. A manufacturing method for a reflector for use in an antenna, said method comprising the steps of:

providing at least two separate parts of reflector material in a first region, said first region being arranged behind at least one antenna element in use, forming each part of reflector material into a desired shape, and coupling said parts electrically together in such a way that they together can be used as ground plane of the antenna, said connected reflector parts together form a corrugated reflector with current traps, and said at least two separate parts together forming at least one pair of partially enclosed cavities functioning as said current traps, wherein said pair of partially enclosed cavities extends symmetrically from each side of said first region in an outward direction thereof.

* * * * *